United States Patent [19]

Wetzel

[11] 4,316,741

[45] Feb. 23, 1982

[54] BLAST FURNACE PROCESS EMPLOYING EXCHANGE FUEL GAS

[75] Inventor: Rolf Wetzel, Heiligenhaus, Fed. Rep. of Germany

[73] Assignee: Krupp-Koppers GmbH, Essen, Fed. Rep. of Germany

[21] Appl. No.: 141,297

[22] Filed: Apr. 18, 1980

[30] Foreign Application Priority Data

Apr. 26, 1979 [DE] Fed. Rep. of Germany ..... 2916908

[51] Int. Cl.[3] ..... C21B 5/00

[52] U.S. Cl. ..... 75/42

[58] Field of Search ..... 75/41, 42

[56] References Cited

U.S. PATENT DOCUMENTS 3,909,446 9/1975 Miyashita et al. ..... 75/42

*Primary Examiner*—M. J. Andrews

*Attorney, Agent, or Firm*—Michael J. Striker

[57] ABSTRACT

A blast furnace process and plant are provided employing a gas mixture comprising coke oven gas and gasified fine grained to dusty fuels. The mixture is produced in a mixing chamber wherein the raw gas from the gasifier is chilled with purified cool coke oven gas. The gas mixture is separated from dust and desulfurized in a cyclone charged with burn lime dust. Then the gas mixture is fed to the blast furnace proper and enters at temperatures from about 750° C. to 1000° C.

10 Claims, 2 Drawing Figures

Fig.1
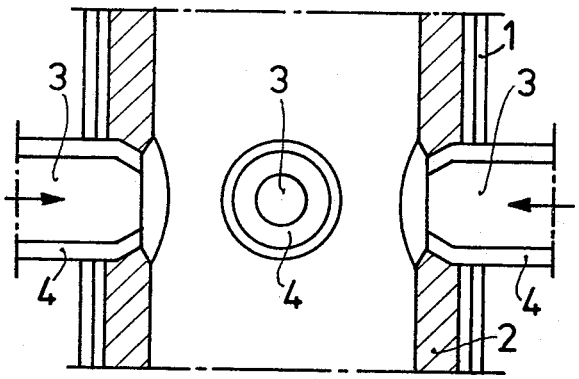
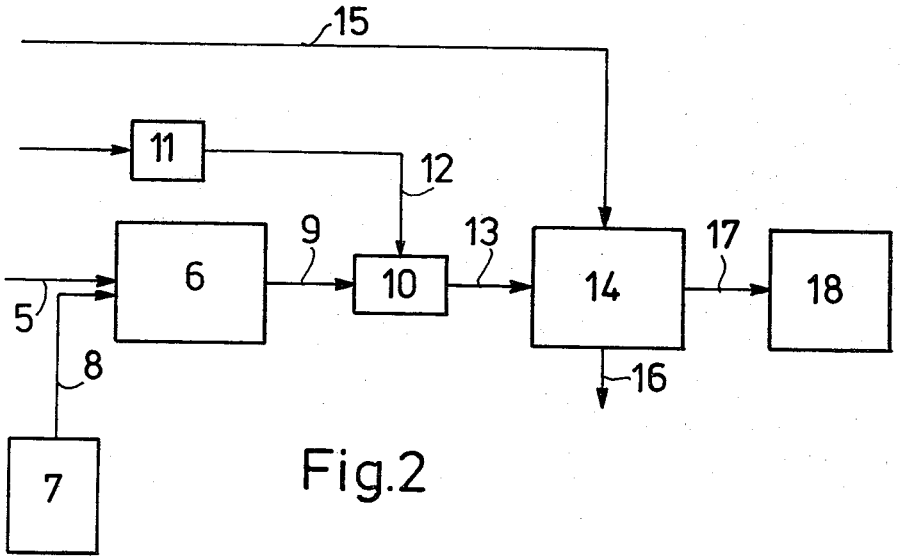
Fig.2

BLAST FURNACE PROCESS EMPLOYING EXCHANGE FUEL GAS

BACKGROUND OF THE INVENTION

1. Field of the Invention

The present invention relates to a process and apparatus for producing pig iron in a blast furnace with reduced feed of specific coke and employing exchange fuel gas obtained by partial oxidation of fine grained to dusty fuel with oxygen and/or air and possibly steam.

2. Description of the Prior Art

It is conventional to save coke in the blast furnace process within certain limits and to substitute exchange fuels such as natural gas or heating oil. The exchange fuels are usually together with the hot blast, fed through blow molds into the blast furnace and are there initially substantially oxidized. This generates the heat required for the endothermal reactions proceeding in the coke zone of the blast furnace:

$$C+CO_2 \rightarrow 2CO \quad (1)$$

$$C+H_2O \rightarrow CO+H_2 \quad (2)$$

These reactions provide the reducing gases for the indirect reduction of the iron oxides in the blast-furnace stack according to the equation:

$$FeO+CO(H_2) \rightarrow Fe+CO_2(H_2O) \quad (3)$$

The direct employment of reduction gases, which are substantially gas mixtures containing carbon monoxide and hydrogen, therefore reduces the use of carbon supplied as coke according to equations (1) and (2). At the same time the heat needed for these endothermal reactions is unnecessary as a result of the addition of the reducing gases. If it is possible to feed the reducing gas as a hot gas to the blast furnace, this allows to save an additional important part of the warm up heat of the blast furnace. This effects at the same time a considerable reduction in the need for hot blast and therefore of the total gas volume and enables a considerable increase in the efficiency of the blast furnace in addition to the savings in coke. This is the case in particular where the reducing gas carries few load components such as for example nitrogen in the blast furnace.

For producing the reducing gases the gasification of fine grained to dusty fuels with oxygen and/or air and possibly with steam can be applied according to the flight stream principle. The produced raw gas upon leaving of the gasifier has a temperature of about 1200° C. and contains in addition liquid to viscous slag particles and hydrogen sulfide as an impurity.

SUMMARY OF THE INVENTION

1. Purposes of the Invention

It is an object of the present invention to provide a blast furnace process employing a reducing exchange gas.

It is another object of the present invention to provide an exchange gas to a blast furnace which is in its composition and temperature adapted to the blast furnace process and enables an optimization of the blast furnace process.

It is a further object of the present invention to chill raw gas from a gasifier with coke oven gas and to hot purify the mixture thus obtained.

These and other objects and advantages of the present invention will become evident from the description which follows.

2. Brief Description of the Invention

The present invention provides a process for producing pig iron in a blast furnace comprising gasifying fine grained to dusty fuels with oxygen and/or air to provide high temperature raw fuel gas comprising carbon monoxide and hydrogen, chilling the raw fuel gas with cooler purified coke oven gas to a temperature of from about 750° C. to 1000° C. to provide a gas mixture and purifying the gas mixture. The purified gas mixture is fed to the blast furnace proper in the area of the blast pipe level (tuyere level, mold plane) or above the blast pipe level at a temperature from about 750° C. to 1000° C. Possibly the gasification is performed in the presence of steam. Preferably the gasification is performed under from about 2 to 6 bar pressure and more preferably under 2.5 to 4 bar pressure. The gasification can be performed in an entrained bed, that is according to the flight stream principle. The coke oven gas can be pressurized to provide for intensive mixing of the individual gas components in the chilling step. The hot purifying step can comprise dedusting and/or desulfurizing. The ratio of gas mixture fed to the blast furnace to pig iron produced can range from about 100 $Nm^3/t$ to 600 $Nm^3/t$. In case of failure of the gasification operation purified coke oven gas can be fed via a bypass conduit to the blast furnace or oil can be injected into the blow forms of the blast furnace as an exchange fuel.

The present invention also provides a blast furnace comprising a gasifier connected to a source of oxidizing agent and to a fuel source. A compressor connected to a source of coke oven gas can supply the coke oven gas to a mixing chamber connected to the gasifier for chilling the raw fuel gas from the gasifier with coke oven gas. The resulting gas mixture is fed via a connecting pipe to a hot dedusting and desulfurizing facility. A source of burnt lime is connected to the dedusting and desulfurizing facility for supplying burnt lime for desulfurization and a conduit is connected to the dedusting and desulfurizing facility to remove residues. The blast furnace proper is connected to the dedusting and desulfurizing facility for receiving the hot purified gas. The source of oxidizing agent can be an air separation plant providing oxygen. The fuel source can provide fine grained to dusty coal particles. The mixing chamber can be a straight tube covered on its inside with refractory material. In one or more planes of the tube nozzles can be provided, which are radially directed to the axis of the tube and which are connected and fed from the compressor with coke oven gas. Cooling jackets can be provided for the nozzles. Alternatively, the tube can have slots as circular sections around the tube and connected to and fed by the compressor. In case of failure of the gasification plant, a valve operated direct connection from the compressor to the blast furnace proper can be provided or the blast furnace proper can comprise oil injectors fed with fuel oil.

The invention accordingly consists of the features of construction and series of steps which will be exemplified in the blast furnace process hereinafter described and of which the scope of application will be indicated in the appended claims.

BRIEF DESCRIPTION OF THE DRAWINGS

In the accompanying drawings in which is shown one of the various possible embodiments of the invention:

FIG. 1 is a sectional view through the mixing tube wherein the raw gas produced by the gasifier is intensely mixed with cooler purified coke oven gas; and FIG. 2 is a schematic flow diagram of the apparatus and process of the present invention.

DETAILED DESCRIPTION OF THE PREFERRED EMBODIMENTS

In accordance with the present invention the raw gas coming from the gasifier at temperatures of more than about 1200° C., which serves as an exchange fuel and which comprises essentially carbon monoxide and hydrogen, is chilled by the addition of cooler, purified coke oven gas to a temperature of from about 750° C. to 1000° C. The gas mixture is then fed to a hot dedusting and desulfurizing facility and the now substantially purified gas mixture is blown into the blast furnace proper in the area of the mold plane or above the area of the mold plane at temperatures of from about 750° C. to 1000° C.

Solid fuels of a variety of origins and qualities can be employed according to the present invention for the production of the raw gas used as an exchange fuel. In case the solid fuels are not provided with a grain size with 60 to 90 percent smaller than 90 micron and a humidity content of less than about one to two percent for bituminous coal and for coals of higher carbon content and of about 6 to 8 percent for subbituminous coal they are first subjected to grinding and drying. Then the fuel employed is fed to the gasifier and there partially oxidized in a flame reaction with oxygen and/or air and preferably with oxygen of high purity of about 98 volume percent $O_2$ and possibly in the presence of steam. The resulting raw gas comprises essentially carbon monoxide and hydrogen, and small amounts of water vapor and carbon dioxide and flue dust and a large part of the sulfur of the fuels employed as hydrogen sulfide.

The raw gas has a temperature of more than about 1200° C. upon leaving the gasifier and carries in addition liquid to pasty slag drops. The chilling of the raw gas in accordance with the present invention is performed in a suitably constructed mixing chamber under addition of cooler, purified coke oven gas. The volume of coke oven gas employed is such as to assure the reaching of the desired temperature for the gas mixture.

Then the resulting gas mixture can for example be fed via a system of cyclones to which dust of burnt lime is added for providing both a desulfurization and a dust separation. Then the purified gas mixture is blown into the blast furnace in the area of the mold plane or above the area of the mold plane. This can be done either via the blow molds of the hot blast feed or via separate nozzles above the blow mold plane. The nozzles are spaced regularly and about equidistant in a plane of the blast furnace around the circumference of the blast furnace and their number is at least four and at most corresponds to the number of blow molds of the blast furnace under consideration. The prepressure of the hot gas mixture at the nozzles should surpass considerably the operating gas pressure of the blast furnace in order to assure a good mixing of the gas mixture into the blast furnace stack.

In case of a failure of the gasifying operation there can be provided a bypass conduit for the coke oven gas which will allow a temporary operation and of the gas mixture nozzles with the purified cool coke oven gas. Alternatively, the blow molds can be provided with oil injection provision for bridging a failure of the gasifier.

Referring now to FIG. 1 there is shown a mixing tube 1 comprising a straight tube which is covered on its inside over the whole range of the mixing operation with a suitable refractory material lining which can comprise one or more layers. The feed of the coke oven gas to the mixing tube is provided by four coke oven gas nozzles 3 placed in one or more planes normal to the tube axis and at angles of 90° as seen from the tube axis. Preferably the nozzles are provided with a cooling jacket 4 which can be cooled with water. Furthermore they are directed toward the tube axis or in tangent direction of a circle around the tube axis. Alternatively to the embodiment shown in FIG. 1, the coke oven gas can also be fed through one or more circular slot sections provided in the wall of the tube 1.

The schematic flow diagram of FIG. 2 represents a blast furnace process embodiment according to the present invention. The suitably dried and ground coal is fed via a conduit 5 to a gasifier 6 and simultaneously required oxygen is fed from an air separation plant 7 via conduit 8 to the gasifier 6. The gasifier can be a conventional gasifier such as a Koppers-Totzek gasifier. The gasification is performed under a pressure of from about 2 to 6 bar and preferably under a pressure of from about 2.5 to 4 bar and the resulting raw gas leaves the gasifier 6 via a conduit 9 at a temperature of about 1450° C. The raw gas can have approximately the following composition:

CO: 66 volume percent
$CO_2$: 2 volume percent
$H_2$: 27 volume percent
$H_2S$: 0.8 volume percent
$N_2$: 4.2 volume percent The raw gas is fed to the mixing chamber 10 which can be constructed as shown in FIG. 1. The coke oven gas can have the following composition:

CO: 5.3 volume percent
$CO_2$: 2.1 volume percent
$H_2$: 57.6 volume percent
$CH_4$: 22.9 volume percent
$C_mH_u$: 2.4 volume percent
$N_2$: 9.4 volume percent Purified cooled coke oven gas is densified in the compressor 11 and fed via conduit 12 into the mixing chamber 10 and there mixed to the raw gas for obtaining a temperature of the gas mixture of about 850° C. The quantity of coke oven gas fed through conduit 12 corresponds to about 0.8 of the amount of raw gas employed. The gas mixture resulting from the mixing chamber 10 is fed via conduit 13 to the dust separation and desulfurizing facility 14, which is preferably constructed as a cyclone, and which provides for a substantial purification of the gas mixture. For this purpose burnt lime is fed via conduit 15 to the dust separation and desulfurizing facility and the separated flue dust and the desulfurizing agent are withdrawn via conduit 16. The purified gas mixture leaves the dust separation and desulfurizing facility via conduit 17 and enters into the blast furnace proper 18 as described above. Employing an amount of gas mixture of 100 $Nm^3/t$ pig iron then about 20,000 $Nm^3$ of gas mixture are fed per hour to a blast furnace with a stack diameter of 10 meters and a production capacity of 200t pig iron per hour. Other details of the blast furnace process can be performed by conventional steps.

It is an advantage of the present invention that the blast furnace process employs coke oven gas and oxygen, which are regularly available in the usual blast furnace installation based on the coke plant and the air separation plant.

It thus will be seen that there is provided a blast furnace process which achieves the various objects of the invention and which is well adapted to practical use.

It is to be understood, however, that the description of the preferred embodiment of the invention is merely given for the purposes of illustration as is not to be taken as a limitation.

While the invention has been illustrated and described as embodied in the production of pig iron, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A process for producing pig iron in a blast furnace comprising: gasifying fine grained to dusty fuels with oxygen and/or air to provide a high temperature raw fuel gas comprising carbon monoxide and hydrogen; chilling the raw fuel gas with cooler purified coke oven gas to a temperature of from about 750° C. to 1000° C. to provide a gas mixture; hot purifying the gas mixture; and feeding the gas mixture to the blast furnace proper in the area of the blast pipe level or above the blast pipe level at a temperature from about 750° C. to 1000° C.

2. The process as set forth in claim 1 wherein the gasification is performed in the presence of steam.

3. The process as set forth in claim 1 wherein the gasification is performed in an entrained bed.

4. The process as set forth in claim 1 wherein the hot purifying step comprises dedusting and/or desulfurizing.

5. The process as set forth in claim 1 wherein the gasification is performed under from about 2 to 6 bar pressure.

6. The process as set forth in claim 1 wherein the gasification is performed under from about 2.5 to 4 bar pressure.

7. The process as set forth in claim 1 wherein the coke oven gas is pressurized to provide for intensive mixing of the individual gas components in the chilling step.

8. The process as set forth in claim 1 wherein the ratio of gas mixture fed to the blast furnace to pig iron produced ranges from about 100 $Nm^3/t$ to 600 $Nm^3/t$.

9. The process as set forth in claim 1 further comprising: feeding cold, purified coke oven gas via a bypass conduit to the blast furnace in case of failure of the gasification operation.

10. The process as set forth in claim 1 further comprising injecting oil as an exchange fuel in the blow forms of the bast furnace in case of failure of the gasification operation.

* * * * *